United States Patent [19]

Peterson

[11] Patent Number: 5,062,464

[45] Date of Patent: Nov. 5, 1991

[54] VERTICALLY COLLAPSIBLE WALL PARTITIONS

[75] Inventor: Miles Peterson, Baie D'Urfe, Canada

[73] Assignee: Diesel Kiki Co. Ltd., Baie d'Urfe, Canada

[21] Appl. No.: 675,549

[22] Filed: Mar. 25, 1991

[51] Int. Cl.[5] ..... E05F 15/00

[52] U.S. Cl. ..... 160/193; 160/138; 160/168.1

[58] Field of Search ..... 160/193, 137, 162, 163, 160/164, 168.1, 138, 84.2, 84.3, 165, 147, 150

[56] References Cited

U.S. PATENT DOCUMENTS

| | | | |
|---|---|---|---|
| 702,146 | 6/1902 | McCloud | 160/147 |
| 1,832,966 | 11/1931 | Cook et al. | 160/164 X |
| 1,892,340 | 12/1932 | Guth | 160/193 |
| 1,965,262 | 7/1934 | Seregi | 160/165 X |
| 2,188,300 | 1/1940 | Mishlenick | 160/165 X |
| 3,378,059 | 4/1968 | Young | 160/165 |
| 3,578,060 | 5/1971 | Spencer | 160/172 |

*Primary Examiner*—David M. Purol

*Attorney, Agent, or Firm*—Kane, Dalsimer, Sullivan, Kurucz, Levy, Eisele and Richard

[57] ABSTRACT

A rigid wall partition system which is vertically upwardly movable into storage position and vertically downwardly movable to form a continuous wall. The system comprises a plurality of panels secured to members which in turn are pivotally secured to spaced trains of single pantographs, contraction of the pantograph causing the panels to fold, in accordion fashion and expansion of the pantographs causing the panels to move to vertical, wall-forming position.

8 Claims, 5 Drawing Sheets

VERTICALLY COLLAPSIBLE WALL PARTITIONS

BACKGROUND OF THE INVENTION

The present invention relates to a wall partition system, and more particularly to a rigid wall partition system which is vertically upwardly movable into storage position and vertically downwardly movable to form a wall.

Movable wall partition systems have many applications, particularly to divide areas of a building and form smaller areas out of larger ones. Convention halls and large rooms in hotels, school gymnasiums and work areas in factories are only a few types of interior building spaces in respect of which movable partition walls are often used to divide them into smaller spaces.

Such walls may be formed merely from fabric or other like material, and take the form of curtains which may be drawn or withdrawn. Other, more durable types of movable wall partitions are made of rigid material, extending from floor to ceiling and having heat and/or sound insulating materials between a rigid wall-forming exterior. Presently, known wall partition systems of the rigid-type conventionally move horizontally. These types of movable walls usually require storage space (in plan) to accommodate the wall panels when not in use. The wall panels may be very heavy and hence the loads imposed on the support structure (ceiling of the room, roof of the building, etc.) are not constant as the panels are moved and increase as the wall panels are tracked towards their storage positions.

Such horizontally movable rigid walls are presently available in three basic types:

(1) individual panels, (2) paired panels (two hinged together), and (3) continuously hinged panels (all hinged together).

Individual panels can be put in place one at a time, either manually or mechanically. Paired panels must be put in place manually. Continuously hinged panels can be put in place either manually or individually. Individual panels have no hinges as they are not joined together and must be moved one at a time, for example on rails embedded in the ceiling or roof of the space in which they operate. Paired panels and continuously hinged panels have exposed hinges which may be unsightly and limit the applications to which they may be applied.

Other drawbacks associated with movable wall partitions which move horizontally on tracks or rails attached to the underside of the ceiling or roof structure of the given space include: (a) the finished wall size is restricted as the component panels are limited as to their weight and size, (b) most of the larger walls must be manually operated since friction and weight prevent automation, (c) they require significant storage space (in plan), thereby adding to building costs, (d) the wall panels tend to jam between ceiling and the floor due to roof deflection caused by snow or rain loading, etc., and (e) they cannot be readily modified to meet specific customer requirements (i.e. voids, openings, etc.).

One type of track-carried horizontally movable wall partition system of background interest to the present invention is an accordion door system offered by Moderco Partitions Inc., in which a multiple pantograph construction is suspended from rollers on tracks in the ceiling and alternative vertically oriented panels of flexible material are secured to spaced portions of the pantograph structure so that, as the pantograph is expanded laterally, the partition closes providing a finished corrugated-like appearance.

The pantograph structure suggested in that construction of accordion doors is similar to that for instance found in baby gates, in which a series of beams are pivotally linked together in spaced fashion to provide a series of similar diamonds along the length of the frame. In a single (as opposed to multiple) pantograph construction, a pair of beams of similar size are pivotally linked at their midpoints. Their ends on one end are pivotally linked to the ends of a corresponding pair of beams of similar length, similarly pivoted at their midpoint, and so on. The midpoints of the beams are aligned and form opposed corners of diamond shapes, the other opposed corners of which are formed by the pivotally secured ends of adjacent pairs of intersecting beams. The pantograph structure expands longitudinally, in a direction parallel to the axis formed by the aligned intersection points of the beams, and contracts in a similar fashion. The pantograph structure, in engineering applications, is useful because it causes forces applied longitudinally, in the direction of expansion and contraction of the structure, to be transmitted evenly throughout all of the beams of the structure. As well, all of the apexes of the diamonds formed by the points of intersection of the beams, as the structure is contracted, will arrive at their final, fully contracted position at the same time, meaning that the apexes of diamonds at the outer end, which are moving towards the other end during contraction, will move at a much greater speed than the apexes of the diamonds at the inner end.

It is an object of the present invention to provide a movable rigid wall partition system which avoids many of the problems found with previously known horizontal movable rigid wall partition system. It is a further object of the present invention to provide a novel construction of vertically movable rigid wall partition system.

SUMMARY OF THE INVENTION

In accordance with the present invention there is provided a rigid wall partition which is vertically upwardly movable into storage position and vertically downwardly movable to form a wall. The partition comprises a support frame of similarly constructed, vertically aligned trains of elongated members. The trains are spaced horizontally over a predetermined distance. The members of each train are arranged in a single pantograph construction to form a single row of similar sized vertically stacked diamonds aligned parallel to a desired wall line of the wall. The trains are expandable to a lower, wall-forming position and upwardly liftable to an upper, raised storage position. The diamonds of the trains from one train to the next form horizontal rows of diamonds, the diamonds in each horizontal row being of similar size and shape. In each train similar pairs of elongated members intersect and are secured pivotally together centrally between their ends to form adjoining vertically disposed apexes of adjacent diamonds. Corresponding ends of these pairs of intersecting members pivotally connect to the ends of other pairs of intersecting members to form at those ends laterally disposed apexes of the diamonds so that when the rows are all contracted and the vertical apexes of the diamonds are drawn together, the diamonds are collapsed about their lateral apexes.

Associated with each of the diamonds is a pair of similar-sized elongated panel supporting members. The panel supporting members are pivotally secured at one end of each to each other and at their other ends to a member on one side of the pantograph opposite respective vertically disposed apexes of that diamond. The panel supporting members are of a length such that they are vertically oriented when the trains are expanded to a predetermined limit. Similar rigid panels are provided, each panel secured to a panel support member of each train at the corresponding height in a horizontal row, with different panels being secured at different heights, so that the panels extend laterally and provide a continuous wall surface when the panel support members are in vertical orientation. A first horizontally oriented beam member joins the trains at their bottom and a second horizontally oriented beam member joins the trains at their top. A mechanical means associated with the first horizontally oriented beam member is actuable to cause the first beam member to lift while maintaining its horizontal orientation, with the diamonds collapsing at the same rate as the first beam is lifted to upper, storage position.

In a preferred embodiment of the present invention, similar panel support members and panels are similarly secured to both sides of the pantograph trains to provide a continuous wall surface on both sides of the pantograph trains when the panel support members are in vertical orientation.

In operation, the vertically movable wall partition system according to the present invention is essentially made from parallel rigid panels mechanically joined together as a type of pantograph. As the pantograph trains are collapsed upwardly, the wall is moved upwards and folds like an accordion. Since the rigid panels are connected to each other, the wall, as a whole, can be fully automated. Further, the connections and hinges are, because of the construction used, made invisible to the eye from the wall side or (in the case of the double wall embodiment) sides.

Because the rigid wall panels move vertically rather than horizontally, storage space (in plan) is not required since the wall folds and stores at the ceiling elevation above the location of the wall. In other words, the wall does not relocate laterally. Thus, a significant advantage achieved by the present invention over prior art horizontally movable rigid wall partitions is that the loads imposed on the support structure are constant. The weight of the wall remains the same whether the wall is up or down (open or closed).

BRIEF DESCRIPTION OF THE DRAWINGS

These and other objects and advantages of the invention will become apparent upon reading the following detailed description and upon refer to the drawings in which.

Figure 1:
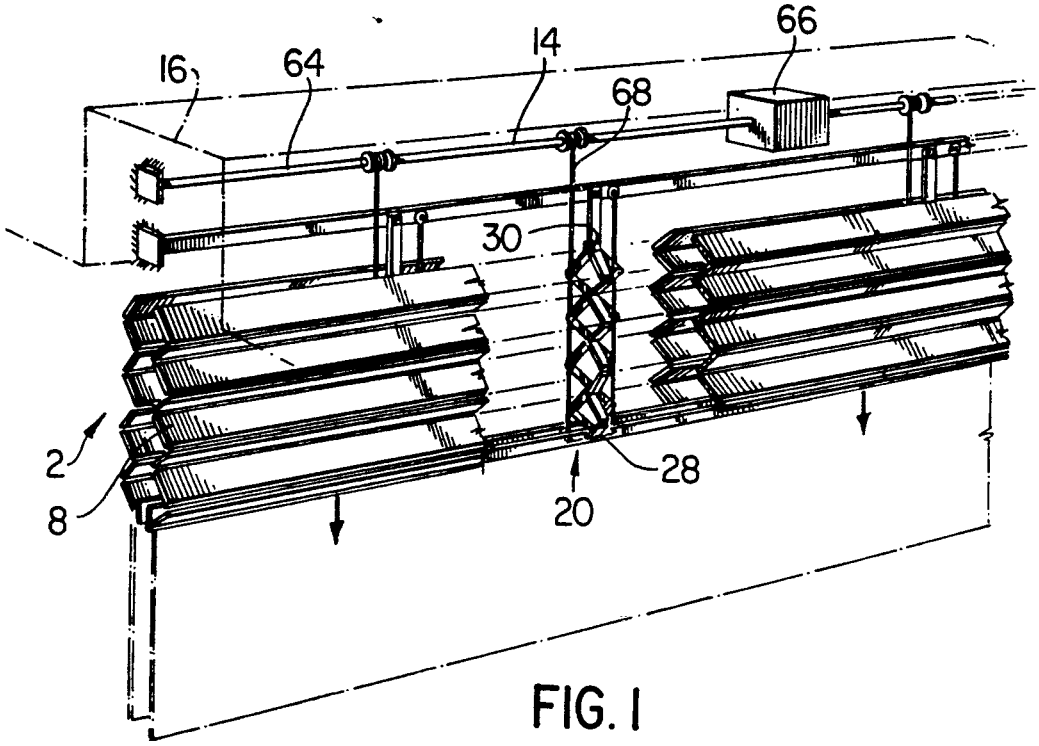
FIGS. 1 and 2 are schematic perspective partial views, partially broken away, of a rigid movable wall partition system according to the present invention respectively, in half-lowered and in lowered, forming position.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
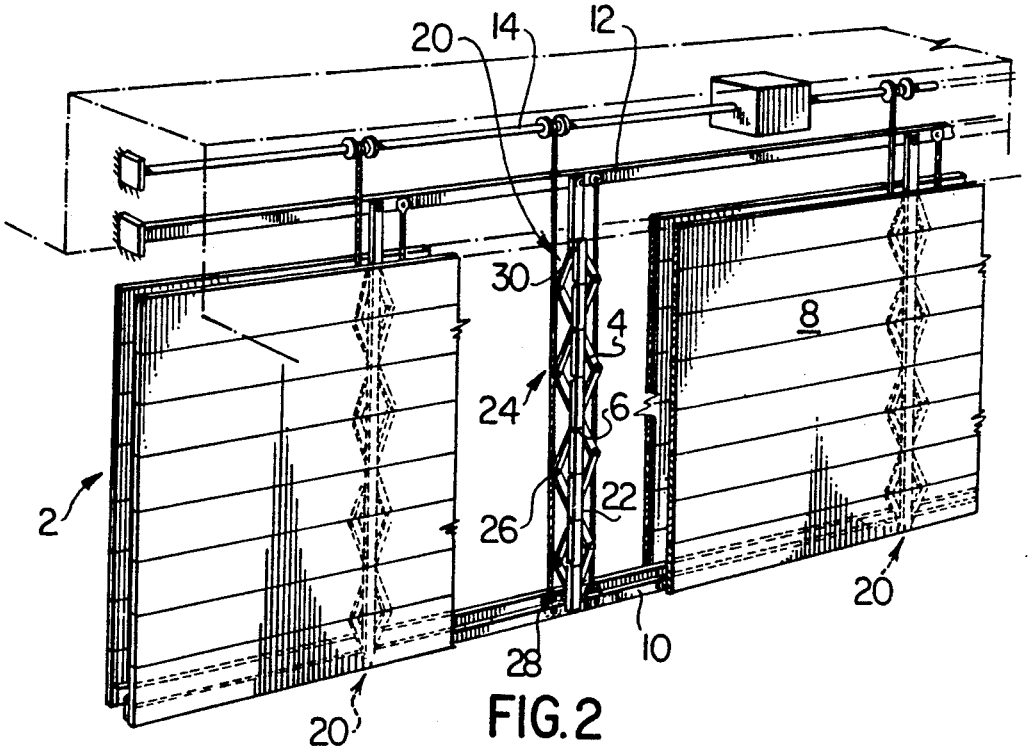

Turning to FIGS. 1 and 2 there is illustrated respectively in half-lowered and lowered, wall-forming position, a vertically movable, rigid wall partition system 2 according to the present invention. The system essentially comprises a skeletal framework, along the center line of the wall to be formed, of elongated members 4 in single pantograph form with the pantograph oriented to be vertically expandible. Secured thereto in a manner which will be described in more detail hereinafter are panel support beams 6, rigid panels 8, lower pantograph support beam 10, upper pantograph support beam 12 and a mechanical power system 14 for raising and lowering system 2. Upper pantograph support beam 12 is maintained in fixed, horizontal position at the top of the area where the wall is to be formed. System 2 may be, as illustrated, housed within a storage well 16 in the ceiling of the building in which it is installed and will have overall dimensions such that, when it is in lowered, wall forming position, it will form a unitary wall across an area to be enclosed.

Figure 3:
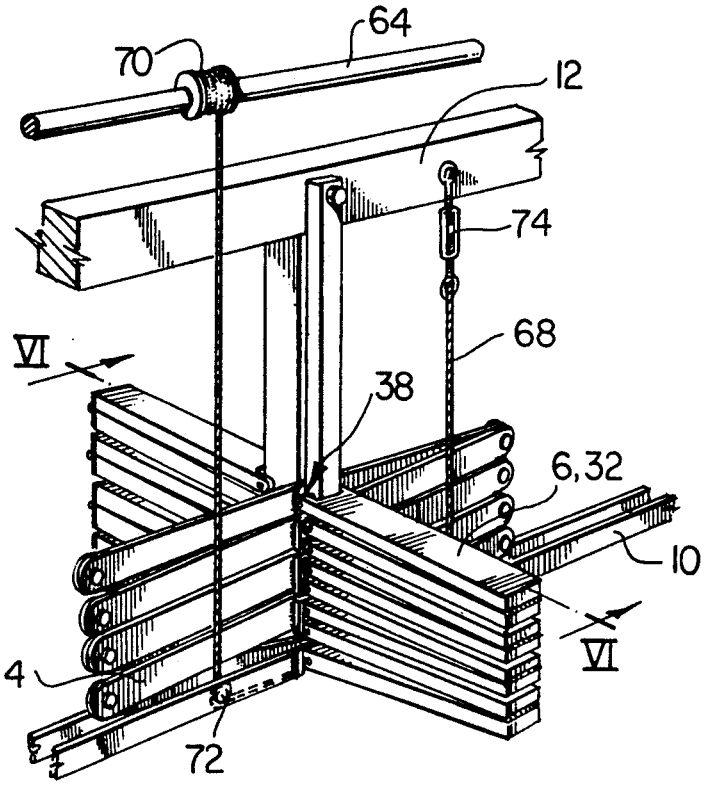
FIG. 3 is a schematic perspective partial view of one of the pantograph trains of the system of FIG. 1, without panels, for greater clarity, in collapsed storage position.

A more detailed understanding of the construction and operation of system 2 is provided in FIGS. 3 to 7. As can be seen in FIGS. 2 and 3, elongated members 4 form a series of vertically aligned trains 20, these trains being spaced in the horizontal direction over a predetermined distance as illustrated. The members 4 forming each train form a single, vertically expandable and contractable pantograph, members 4 being pivotally connected at their midpoints to form central, vertically disposed apexes 22 of adjoining diamonds 24 and the ends of members 4 pivotally secured to the ends of similar pairs of members to form laterally disposed apexes 26 of diamonds 24. The pantographs forming trains 20 are aligned so that the diamonds 24 lie with their planes along the center line of the wall to be formed. All of members 4 (except the two most extreme members of the end diamonds of each train 20) are of the same length. Thus, by ensuring that upper and lower pantograph support beams 10 and 12 are horizontally oriented, horizontal rows of diamonds 24, from one train 20 to the next, are provided. Lower and upper pantograph support beams 10 and !2 are secured to the corresponding diamonds 24 respectively at their lower apex 28 and upper apex 30, in such a manner, of course, that the corresponding beams of those diamonds are free to pivot at apex 28 and 30.

It will be understood that by lifting lower pantograph support beam 10 from the position illustrated in FIG. 3, all of the vertically disposed apexes 22 will reach the upper, fully retracted wall position, at the same time. This motion will cause diamonds 24 to collapse essentially at the same rate, as the lower vertically disposed apex 22 of each is moved towards its upper apex 22.

Figure 4:
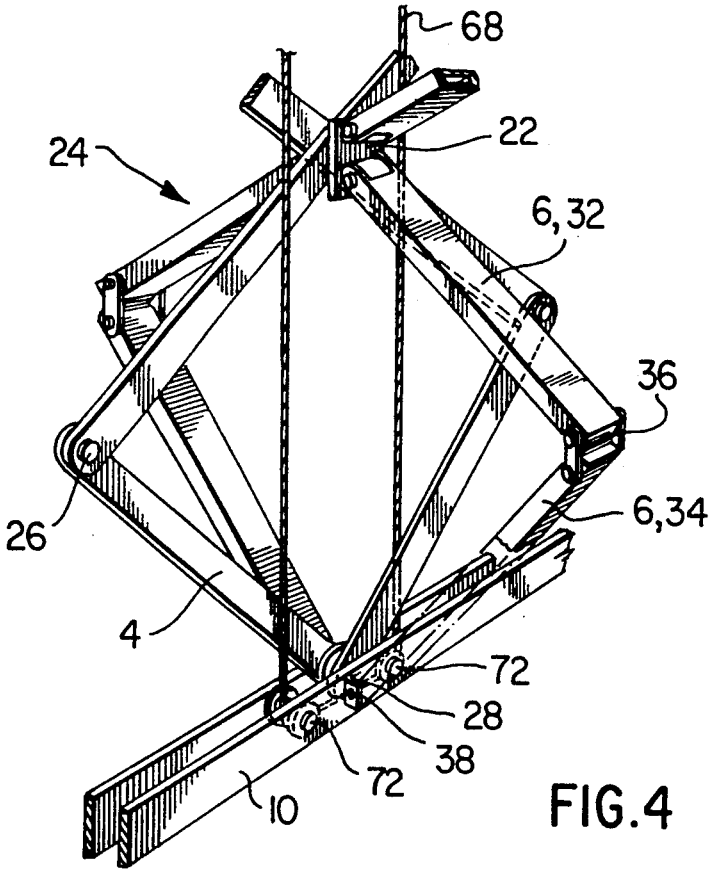
FIG. 4 is an enlarged perspective partial view of the lower portion of one of the pantograph trains of the system in expanded position, without panels, detailing part of the lifting and lowering mechanism.

As can be seen in FIGS. 3 and 4, on each side of trains 20 formed by members 4 are pivotally secured to panel support beams 6. In particular, for a particular diamond 24 formed by members 4, on one side thereof, an upper panel support beam 32 and a lower panel support beam 34 are provided. Beams 32 and 34 are pivotally secured together by a hinge 36 (which will be hidden from view when these beams are clad with panels 8). The other ends of beams 32 and 34 ar pivotally secured to members 4 adjacent corresponding apexes 22, by hinges 38, as illustrated. For ease of subsequent description, hinges 38 will be called "A" hinges and hinges 36 will be called "B" hinges. "A" hinges are essentially anchored to the pantograph structure formed by members 4 in a particular train, and the "B" hinges move in or out or "float" with respect to the plane of diamonds 24 of trains 20 during expansion or retraction of those trains. For a two-sided wall panel system, the system which has been illustrated, each of the diamonds 24, on each side of each of the trains 20, is provided with a cooperating pair of panel support beams 32 and 34 similarly hinged with hinges 36 and 38.

Panel support beams 32 and 34 are of a similar length, that length being such as to ensure that beams 32 and 34 are in vertical orientation when trains 20 have been expanded fully to their wall-forming position (e.g., FIG. 2). Thus, a panel 8 secured to panel support beam 32, and another panel 8 secured to panel support beam 34, these panels being of a width, in the vertical direction, corresponding to the length of its corresponding panel support beam, will provide a wall having a solid, planar, unbroken appearance when beams 32 and 34 are in this vertical orientation. Panels 8 are preferably of a rectangular construction, elongated in the horizontal direction, a single panel or a set of panels 8 being secured to all of the panel support beams 32 (or 34, as the case may be) of trains 20, which lie horizontally at the same level. It is preferred that a small spline 40 of flexible material be secured to the confronting sides 42 of panels 8 in horizontal and vertical directions so as to provide acoustical insulation between adjacent panels.

Figure 6:
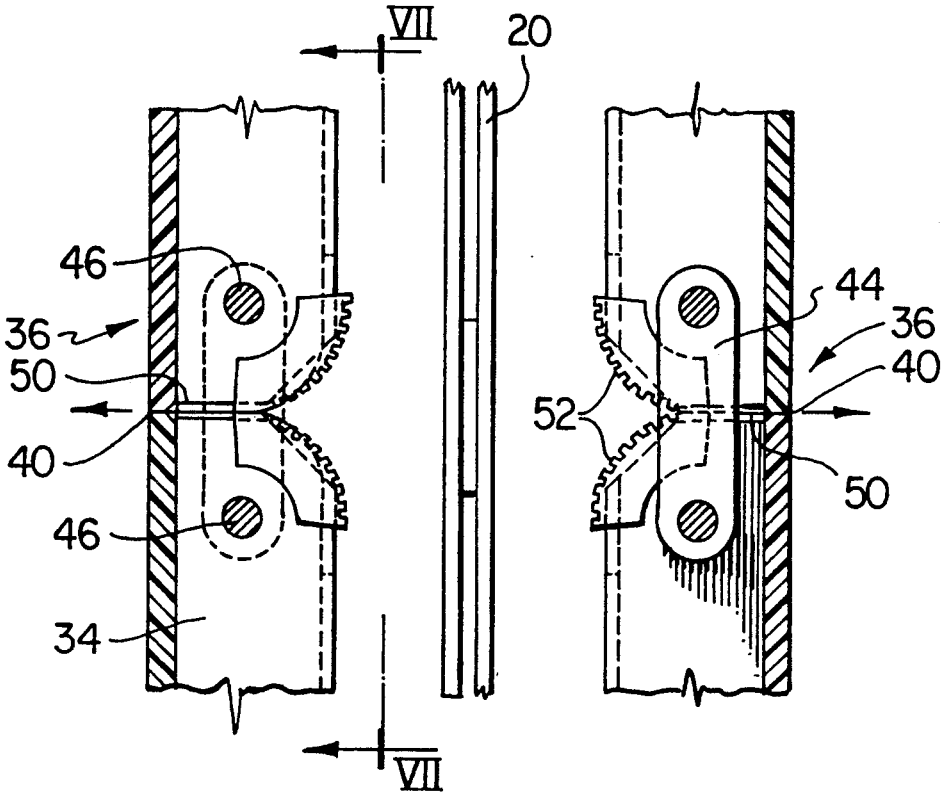
FIG. 6 is a partial view in section along line VI—VI of FIG. 3 but with the pantograph in lowered wall-forming position illustrating the pivotal connection of the joined ends of a pair of panel support members.
Figure 7:
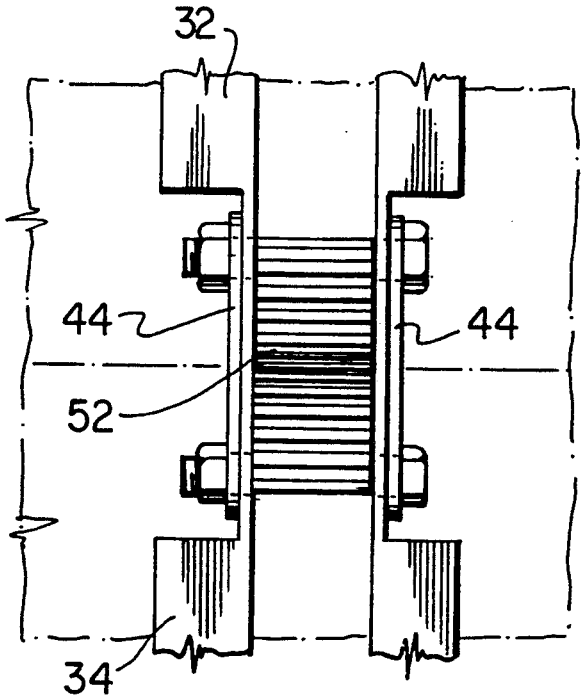
FIG. 7 is a view along line VII—VII of FIG. 6.

To ensure that the "B" hinges joining a cooperating pair of panel support beams 32 and 34 are not visible when the panels 8 are vertically oriented in wall-forming position, a standard form of butt hinge has been found unsuitable. Instead, as can be seen in FIGS. 6 and 7, a pair of link bars 44 have been pivotally secured to each of panel support beams 32 and 34 at spaced pivot points 46, which pivot points are inwardly positioned from outer surfaces 48 of these panel support beams (FIG. 6) so they are not visible to the outside. To ensure, with this arrangement, that cooperating panel support beams 32 and 34 maintain their relative positioning and, as their confronting ends 50 move outwardly or inwardly during contraction or expansion of trains 20, cooperating curved spur gears 52 are provided. Spur gears 52 are formed and positioned on ends 50 of beams 32 and 34 so that the engagement of the teeth of these gears maintains the beams 32 and 34 in appropriate position at all times and one of these beams swings outwardly or inwardly only at the same rate as the other during retraction or expansion of trains 20.

The "A" hinges for panel support beams 32 and 34 may be of any appropriate construction to achieve the desired motion of the beams. "A" hinges of course must each be secured to a portion of train 20 in the vicinity of a vertically disposed apex 22 in a manner that does not interfere with the pivotal operation of members 4.

Figure 5A:
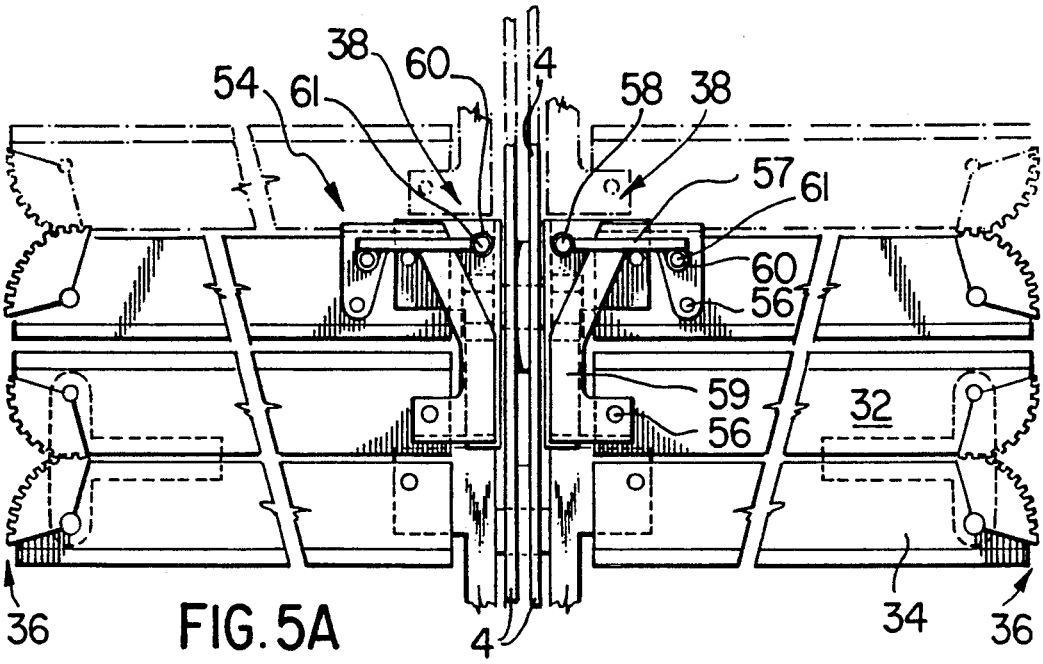
FIGS. 5A and 5B are partial side views of a portion of the pantograph and panel support members of the system respectively in raised, storage position and lowered, wall-forming position.
Figure 5B:
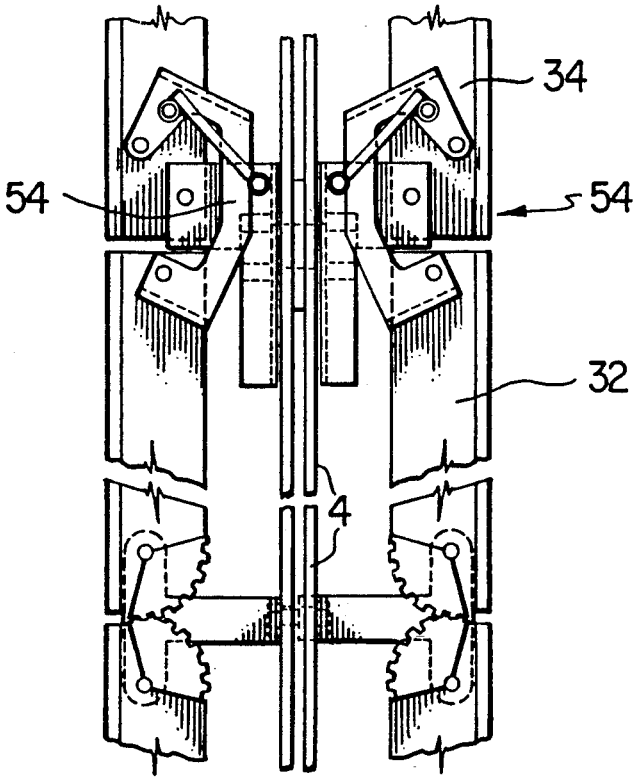

An appropriate arrangement of hinge 38 is illustrated, in sequential configurations, on one side of members 4, in FIGS. 5A and 5B. Each of the ends of cooperating beams 32 and 34 at this "A" hinge is individually hingedly secured, by means of a four-point pivot hinge 54, to one of the members 4 near the corresponding apex 22, where the members are pivotally secured to each other, as illustrated, so that as members 4 move from collapsed (FIG. 5A) to fully expanded, wall-forming position and back to collapsed position, the confronting ends of cooperating beams 32 and 34 are prevented from obstructing each other. Hinge 54 is pivotally secured to cooperating beams 32 and 34 at pivots 56. Bar 57 has one end pivotally secured at pivot 58 to base 59 of hinge 54, which base is secured to the corresponding member 4. To the other end of bar 57 is welded a sleeve 60, within which is pivotally secured a projection 61 secured to the main body of hinge 54 as illustrated. In this way, the four-pivot points, which provide the desired motion of beams 32 and 34, are provided.

Figure 8A:
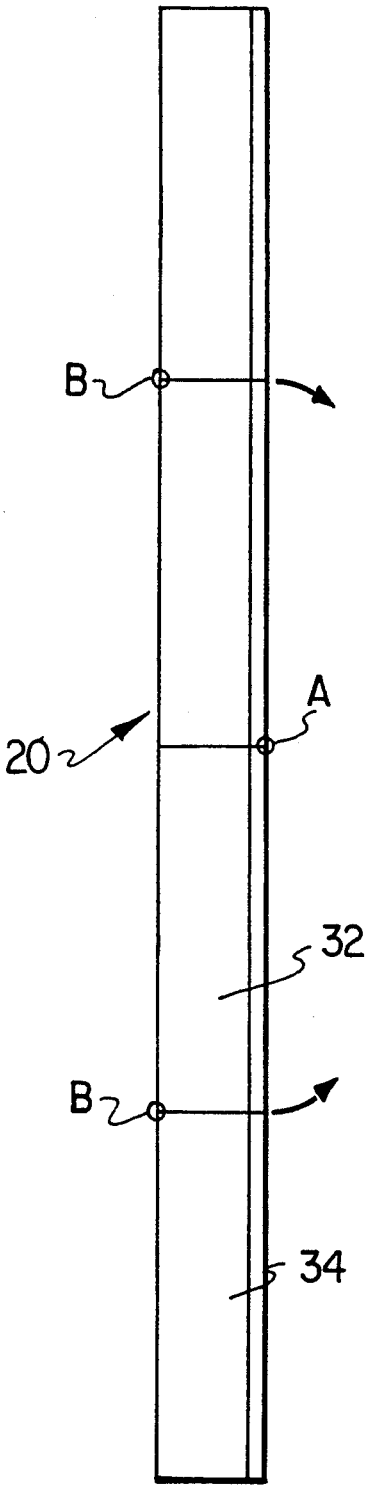
FIGS. 8A and 8B are schematic views from the side of a series of adjacent panel support members in vertical, wall-forming position, respectively illustrating improper and proper orientations of relative pivot points of the members.
Figure 8B:
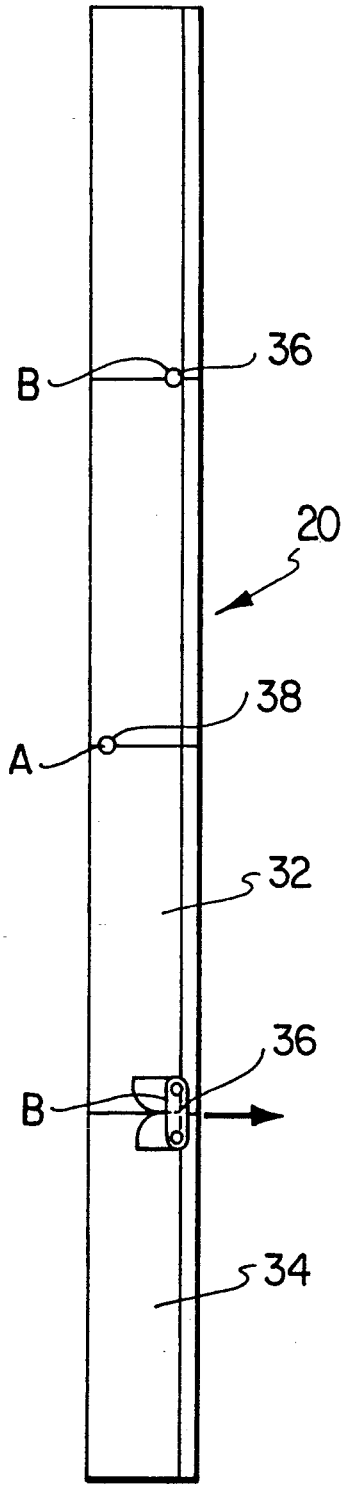

As can be seen in FIGS. 8B, when it is desired to lift trains 20 from their fully expanded, wall-forming position, to ensure that cooperating panel support beams 32 and 34 along the lengths of trains 20 do not freeze in vertical position, it is important that the "B" hinges are outwardly positioned with respect to the "A" hinges, in a vertical sense. In this way, when upward forces are applied by means of lower pantograph support beam 10 acting on the lower apex 28, the floating "B" hinges 36 will be properly positioned to commence pivoting outwardly about their corresponding "A" hinges at the other ends of the corresponding panel support beams 32 and 34. Thus, the configuration of "A" and "B" hinges o support beams 32 and 34 illustrated schematically in FIG. 8B is the proper one. With the improper construction illustrated in FIG. 8A, an upward force on panel support beam 32 and 34 would cause the "B" hinge to tend to pivot inwardly, against train 22 or to freeze in that locked position. Consequently, the relative positioning of the "A" and "B" hinges illustrated in FIG. 8A would result in an inoperative construction.

For movement of trains 20 upwardly and downwardly into storage and wall-forming positions, a mechanical power system 14, illustrated schematically in FIGS. 1 and 2 is provided. Power system 14 comprises a line shaft 64, powered by a motor 66. Line shaft 64 is preferably positioned in the ceiling above trains 20 and extends in parallel fashion along the length of panels 8 as illustrated. A plurality of cables 68, one for each train 20 is provided, one end of the cable being wound about a corresponding cable drum 70. In the illustrated embodiment, cable 68 is guided down to a pair of pulleys 72 secured in lower pantograph support beam 10 on either side of lower apex 28, and then up to an appropriate adjustment means 74 (FIG. 3) whereby the length of cable 68 extending from drum 70 may be adjusted. This adjustment is important to ensure that cables 68 are all taut for operation of system 2, and that lower pantograph support beam 10 is in horizontal orientation.

In operation, if the system 2 is in wall-forming position as illustrated in FIG. 3, with panels 8 vertically oriented and in abutting relationship, if it desired to raise the panels 8 into storage position, motor 66 is activated to turn line shaft 64 so that the lift cables 68 will be simultaneously and equally wound on their corresponding drums 70. This will cause lower pantograph support beam 10 to be raised, while maintaining its horizontal orientation, collapsing pantograph trains 20. This action will cause the "B" hinges of panel support beams 6 to move outwardly away from the plane of diamonds 24 of the trains 20 and thereby cause the panels 8 to fold up, in accordion fashion, as trains 20 are retracted into storage position in storage well 16. The rotation of line shaft 64 in the opposite direction will cause unwinding of cables 68 from their corresponding cable drums 70, to lower pantograph support beam 10 and cause the panels 8 to progressively return to vertical, wall-forming orientation.

Thus it is apparent that there has been provided in accordance with the invention a rigid wall partition that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A rigid wall partition vertically upwardly movable into storage position and vertically downwardly movable to form a wall comprising a support frame of similarly constructed, vertically aligned trains of elongated members, the trains spaced horizontally over a predetermined distance, the members of each train arranged in a single pantograph construction to form a single row of similar-sized vertically stacked diamonds aligned parallel to a desired wall line of the wall, the trains being expandable to a lower, wall-forming position and upwardly liftable to an upper, raised storage position, the diamonds of the trains forming from one train to the next horizontal rows of diamonds, the diamonds in each horizontal row being of similar size and shape, in each train similar pairs of elongated members intersecting and secured pivotally together centrally between their ends to form adjoining vertically disposed apexes of adjacent diamonds and corresponding ends of these pairs of intersecting members pivotally connected to the ends of other pairs of intersecting members to form at those ends laterally disposed apexes of the diamonds so that when the rows are all contracted and the vertical apexes of the diamonds are drawn together, the diamonds are collapsed about their lateral apexes; a pair of similar-sized elongated panel supporting members associated with each of the diamonds, the panel supporting members pivotally secured at one end of each to each other and at their other end to on side of the pantograph opposite respective vertically disposed apexes of that diamond, the panel supporting members being of a length such that they are vertically oriented when the trains are expanded to a predetermined limit; similar, rigid panels being secured to a panel support member of each train at the corresponding height in a horizontal row with different panels secured at different heights so that the panels extend laterally horizontally over said predetermined distance, and provide a continuous wall surface when the panel support members are in vertical orientation; a first horizontally oriented beam member joining the trains at their bottom and a second horizontally oriented beam member joining the trains at their top; mechanical means associated with the first horizontally oriented beam member and actuable to cause the first beam member to lift while maintaining its horizontal orientation, the diamonds to collapse at the same rate as the first beam is lifted to upper, storage position.

2. A partition according to claim 1 wherein similar panel support members and panels are similarly secured to both sides of the pantograph trains to provide a continuous wall surface on both sides of the pantograph trains when the panel support members are in vertical orientation.

3. A partition according to claim 2 wherein confronting edges of adjoining panels are joined together with flexible splines to provide accoustical insulation.

4. A partition according to claim 1 wherein said drive means comprises a cable means extending from a power driven rotatable line shaft to said first horizontally oriented beam member so that rotation of the line shaft in one direction winding up the cable means causes the trains simultaneously to contract to storage position and rotation of the line shaft in the other direction unwinds the cable and causes the trains simultaneously to expand to wall forming position.

5. A partition according to claim 4 wherein the line shaft is located above the trains on the center of the wall and the cable means comprises a plurality of cables associated with cable drums secured to the line shaft, a drum position above each train and its associated cable extending to the first beam member at the bottom of the corresponding train.

6. A partition according to claim 5 wherein the free end of each cable is adjustably secured above the corresponding train by securing means, and the cable extends from its corresponding cable drum down to and about pulley means secured to said first beam member at the bottom of the corresponding train and back up to the securing means.

7. A partition according to claim 1 wherein said panel supporting members are pivotally secured to each other at their joined ends by a link means providing a pair of spaced axes of rotation, one for each of the arms, interlocking cooperating gear means provided on the corresponding ends of said members to ensure that a corresponding degree of pivoting of each member with respect to its axis of rotation through the link means during expansion and lifting of the trains is provided.

8. A partition according to claim 1 wherein, with respect to the pair of similar sized elongated panel supporting members associated with each of the diamonds, the panel supporting members that are pivotally secured to each other have their pivots positioned outwardly, towards the corresponding panels, with respect to the pivots at the other ends of those members, when said members are in vertical orientation, so as to ensure proper pivoting of the panel support members out of vertical orientation when the trains are lifted upwardly out of wall-forming position.

* * * * *

UNITED STATES PATENT AND TRADEMARK OFFICE

CERTIFICATE OF CORRECTION

PATENT NO. : 5,062,464

DATED : November 5, 1991

INVENTOR(S) : Miles Peterson

It is certified that error appears in the above-identified patent and that said Letters Patent is hereby corrected as shown below:

On the title page:
Assignee: reads "Diesel Kiki Co. Ltd" should be

--Railtech Ltd., Quebec, Canada--

Signed and Sealed this

First Day of June, 1993

*Attest:*

*Attesting Officer*

Michael K. Kirk

MICHAEL K. KIRK

*Acting Commissioner of Patents and Trademarks*